US007946141B2

(12) United States Patent
Ng et al.

(10) Patent No.: US 7,946,141 B2
(45) Date of Patent: May 24, 2011

(54) SELF-SCRAMBLING COMBINATION LOCK

(76) Inventors: Kwan Yuen Abraham Ng, El Monte, CA (US); Sarah Seen Yui Chan Ng, El Monte, CA (US)

( * ) Notice: Subject to any disclaimer, the term of this patent is extended or adjusted under 35 U.S.C. 154(b) by 0 days.

(21) Appl. No.: 12/111,744

(22) Filed: Apr. 29, 2008

(65) Prior Publication Data

US 2010/0000276 A1 Jan. 7, 2010

(51) Int. Cl.
*E05B 37/02* (2006.01)

(52) U.S. Cl. ..... 70/21; 70/25; 70/63; 70/284; 70/285; 70/311; 70/312; 70/314

(58) Field of Classification Search ..... 70/21, 25, 70/26, 63, 284, 285, DIG. 63, 312, 314–318, 70/320–325, 311, DIG. 22, DIG. 23, DIG. 44, 70/DIG. 71

See application file for complete search history.

(56) References Cited

U.S. PATENT DOCUMENTS 4,343,163 A 8/1982 Scelba et al.
4,520,641 A * 6/1985 Bako ..... 70/312
4,910,981 A 3/1990 Gartner
5,007,262 A * 4/1991 Nakai ..... 70/312
5,235,831 A * 8/1993 Lauria et al. ..... 70/312
5,307,657 A * 5/1994 Klein et al. ..... 70/312
5,345,798 A * 9/1994 Nakai ..... 70/284
6,813,912 B1 11/2004 Ng et al.
7,047,772 B2 5/2006 Yu
7,216,518 B2 5/2007 Shao
7,254,971 B2 8/2007 Ruan
7,290,417 B1 11/2007 Huang

* cited by examiner

*Primary Examiner* — Lloyd A Gall
(74) *Attorney, Agent, or Firm* — Chan Law Group LLP

(57) ABSTRACT

A self-scrambling combination includes a frame that supports at least two tumbler rings and an activating slide. The tumbler rings are marked with characters used for a combination for the lock. The lock is openable only when the tumbler rings are located in an open position related to the combination. The activating slide moves a locking bar between a locked position and an unlocked position. A scrambling mechanism is attached to the activating slide and rotates the tumbler rings from the open position to another position upon movement of the activating slide to move the locking bar from the unlocked position to the locked position. The frame can be used as the door of a lockbox and an attached key lock controls the setting of the combination for the lock. The self-scrambling combination lock can be used for a briefcase or valise lock with an additional spring closing the lock.

19 Claims, 9 Drawing Sheets

SELF-SCRAMBLING COMBINATION LOCK

FIELD OF THE INVENTION

The invention is a combination lock for use with a lockbox for use in real estate sales and related transactions. More particularly, the invention relates to combination locks that will automatically scramble the lock's combination upon locking.

BACKGROUND OF THE INVENTION

Lockboxes are commonly used in the real estate sales industry to provide means for a large number of salesmen to gain access to a locked building. The lockbox is secured to the building and contains a key fitting a lock controlling access to the building. The lockbox key repository is typically secured with a combination lock. A common variety of combination lock used for lockboxes, briefcases, suitcases and even bicycle locks employs a series of rotatable tumbler rings. The rings have a series of numbers, letters or other characters inscribed on them and the alignment of the tumbler rings with the correct combination of such characters will allow the lock to be opened. With most locks of this nature, after the lock has been closed, usually by sliding a button or closing a hasp, the opening combination will still remain visible on the tumbler rings. Unless the user of the lock is careful to scramble the combination, the lock may be easily opened again by any unauthorized person. The present invention addresses this problem by providing a means for the combination to be scrambled automatically upon closing of the lock mechanism.

A number of combination lock designs have been developed that attempt to solve this problem. U.S. Pat. No. 4,910,981 issued to Gartner discloses an automatically self locking and self scrambling combination lock wherein a spring biased bolt is moveable by its bias toward a locking position and a detent is provided on an end of the fence arm associated with a fence lever connected to the bolt whereby on movement of the bolt towards its locking position, the detent engages the edge of a single one of the tumbler wheel gates to scramble that tumbler wheel alignment relative the other tumbler wheels as the fence arm leaves the tumbler wheel gates. Additional spring means are provided in the form of a multiple armed spring member having a first spring arm which urges the fence lever toward the tumbler wheels when the spring member is deflected under the action of an actuator roller once on each rotation of an associated lock shaft, a second spring arm which normally urges the fence lever away from the tumbler wheels when the spring member is not deflected and a third spring arm which normally biases the spring member toward its non-deflected position of rest. In addition, an eccentric roller rim associated with the actuator roller for deflecting the spring member is provided so that the timing of such defective movement of the spring member in response to rotation of the lock shaft varies from rotation to rotation in response to incremental movements of the eccentric rim about its mounting post as it goes through successive engagements with the spring member.

U.S. Pat. No. 4,343,163 issued to Scelba et al. describes a combination lock of the dial and sleeve type that has a scramble feature enabling a hasp to be engaged with a latch of the lock even when the dials and sleeves are not on-combination, by independent movement of the latch relative to manual actuating means of the lock. When the hasp is engaged, it supports the latch in a position in which the latch is adapted to engage a blocking element that prevents the latch from being moved out of its hasp-engaging position independently of the manual actuator. This arrangement effectively prevents the lock from being forced open when the hasp is engaged.

U.S. Pat. No. 7,290,417 issued to Huang describes a suitcase lock that can be opened either by setting a combination or by a key, in which dials of a suitcase lock are disposed with sleeves, and characterized in that a key tumbler is additionally fitted to the suitcase lock, and tongues located at a lower portion of a swing plate clamp connect to a slider. A groove at one end of the slider enables a push rod of the key tumbler to be clamped therein, and sloping grooves defined on another end enable the tongues of the swing plate to displace therein. In general, dials are used to control cuttings or circular arcs on the sleeves to operate the swing plate and hooking to a locked object and realize opening and closing of the lock. However, when in a locked state, without moving the dials, a key can be used to directly activate the key tumbler to push the slider, and thereby causes the swing plate to tilt in an opposite direction and the stopper at one end of swing plate can release the locked object from hooking position, thus opening the lock or suitcase.

U.S. Pat. No. 7,254,971 issued to Ruan describes a combination lock includes a lock body, a locking latch, a numerical actuation unit including a plurality of number rotors and a plurality of locking rings, and a password reset unit. The password reset unit includes a reset driver slidably extended at the lock body to couple with the locking rings, wherein when the reset driver is moved to drive the locking rings to slidably disengage with number rotors, the number rotors are free to rotate on the lock body to reset a new number-combination, such that when the reset driver is released that the locking rings are slidably returned back within the number rotors, the detachable end of the locking latch is unlocked once the number rotors are rotated at the new number-combination.

U.S. Pat. No. 7,216,518 issued to Shao discloses a mechanical dial combination lock for use in safes, file cabinets, security doors, vaults and warehouse doors. The disk type mechanical combination lock features a plurality of annular code discs, a base disc, a latch, an unlatching mechanism, a positioning mechanism, a dialing mechanism, a repositioning mechanism, a code-detecting mechanism, a casing and a dial. The dial combination lock is easily operated by persons familiar with conventional dial-face type combination locks, and yet is may be operated faster, and permits the combination code to be easily changed to any of a greater number of possible code combinations.

U.S. Pat. No. 7,047,772 issued to Yu describes a cable lock includes a case having a slot defined through a first side and an opening defined through the second side and being in communication with the slot. A flexible cable has one end fixed to the case and a free end of the flexible cable is removably engaged with the opening and the slot. A combination unit is received in the case includes a shaft movably extending through the combination unit. A top plate is connected to a top of the shaft and has a stop plate which is located inside of the second side and movably blocks the opening. A button is pivotably connected to the case and drives an action plate to push the top plate and the shaft downward so as to remove the stop plate away from the opening, and the free end of the flexible cable is able to remove from the opening.

U.S. Pat. No. 6,813,912 issued to Ng et al. describes a secure lockbox that includes an interior key lock controlling access to the mechanism for setting and changing the combination for the lock controlling access to the interior storage compartment of the lockbox. A second key lock controls the attachment bail of the lockbox, preventing unauthorized removal of the lockbox. The two key locks may be identically keyed. In a variant of the invention, a second combination lock controls the attachment bail instead of a key lock. Resilient coverings are provided for the attachment bail and the sides of the lockbox body to prevent damage to buildings and fixtures. A chain is provided to secure the door of the lockbox to the body. A slide latch having non-slip features is controlled by the door's combination lock and engages an edge of the door opening to secure the door opening.

It is an objective of the present invention to provide a combination lock suitable for use with a lockbox for use in the real estate sales industry. It is another objective to provide a combination lock that automatically scrambles the combination used to unlock the lock. It is a further objective to provide a combination lock that turns the lock tumbler rings to a different combination each time the lock is locked. It is a still further objective of the invention to provide means to control access to the setting of the combination for the lock. It is a final objective to provide a combination lock that may be easily used, is rugged and reliable and that may be inexpensively manufactured and maintained.

While some of the objectives of the present invention are disclosed in the prior art, none of the inventions found include all of the requirements identified.

SUMMARY OF THE INVENTION

The present invention addresses all of the deficiencies of prior art user-configured lockbox inventions and satisfies all of the objectives described above.

(1) A self-scrambling combination lock may be constructed from the following components. A frame is provided. The frame supports at least two tumbler rings and an activating slide. The tumbler rings are marked with characters used for a combination for the lock. The lock is openable only when the tumbler rings are located in an open position related to the combination. The activating slide moves a locking bar between a locked position and an unlocked position. A scrambling mechanism is provided. The scrambling mechanism is attached to the activating slide and rotates the tumbler rings from the open position to another position upon movement of the activating slide to move the locking bar from the unlocked position to the locked position.

(2) In a variant of the invention, the self-scrambling combination lock, includes a frame. The frame has a top surface, first and second sides and a bottom surface spaced from the top surface. At least two tumbler rings are provided. The tumbler rings are marked with characters used for a combination for the lock. An activating slide is provided. The slide moves a locking bar between a locked position and an unlocked position. The top surface has openings for the tumbler rings and the activating slide. The frame supports an axle. The axle has a series of longitudinal ridges located on its exterior circumference and supports the at least two tumbler rings. The longitudinal ridges extend along a length of the axle and are interrupted by unridged portions, the unridged portions permit rotation of the tumbler rings. The tumbler rings have mating grooves located on interior circumferences of the rings.

The mating grooves and ridges permit the axle to slide laterally through the tumbler rings when the rings are aligned according to the lock's combination. Lateral movement of the axle permits the locking bar to move between the locked position and the unlocked position. Each of the tumbler rings has a barrel section. The barrel section extends laterally on at least one side of the tumbler ring. The barrel section is of a smaller diameter than the tumbler ring and has a notch located on its outer surface parallel to a longitudinal axis of the axle. At least one scrambling bar is provided. The scrambling bar has a first end and a second end, is attached at the first end to the locking bar and has a notch-engaging feature located at the second end. The scrambling bar is urged toward the barrel section by a first elastic element. The notch-engaging feature fits into the notch when the tumbler ring is positioned according to the lock's combination and the activating slide moves the locking bar from the locked position to the unlocked position. The scrambling bar turns the barrel section when the activating slide moves the locking bar from the unlocked position to the locked position. The barrel section turns the tumbler ring to a position other than that of the lock's combination upon locking of the lock.

(3) In another variant, the tumbler rings are removably attached to the barrel sections to permit changing of the lock's combination.

(4) In still another variant, the frame includes a retaining ledge.

(5) In yet another variant, a body is provided. The body has a top surface, side surfaces, an attachment bail and an interior cavity, the interior cavity extends inwardly from an opening in one of the side surfaces. The attachment bail extends upwardly from the top surface of the body and is slidable from a first, open position to a second, closed position. A second combination lock is provided. The second combination lock is located upon the top surface and secures the bail in the second, closed position. A first key lock is provided. The first key lock is located in the frame within the interior cavity and controls selection of a combination for the second combination lock. The frame is sized and shaped to be removably secured to the opening. The frame controls access to the interior cavity through the opening. A second key lock is provided. The second key lock is located within the interior cavity and controls selection of a combination for the self-scrambling combination lock. When the attachment bail is locked through a building fixture with the second combination lock, the combination of the self-scrambling combination lock is set and secured with the second key lock, a building key is inserted in the interior cavity and the frame secured to the opening with the self-scrambling combination lock, access to a building is permitted to only those who have been given the combination and changes to the combination and removal of the body are prevented.

(6) In a final variant of the invention, the frame includes a second elastic member. The second elastic member urges the locking bar toward the locked position. A hasp is provided. The hasp is hingedly attached adjacent the frame and has an engaging loop sized and shaped to fit slidably over an end of the locking bar. The locking bar has a beveled surface at the end so as to slide over the engaging loop. The scrambling bar turns the barrel section when the locking bar is urged by the second elastic member from the unlocked position to the locked position. The barrel section turns the tumbler ring to a position other than that of the lock's combination upon locking of the lock.

An appreciation of the other aims and objectives of the present invention and an understanding of it may be achieved by referring to the accompanying drawings and the detailed description of a preferred embodiment.

DESCRIPTION OF THE DRAWINGS

DETAILED DESCRIPTION OF THE PREFERRED EMBODIMENT (1) FIGS. 1-4 illustrate a self-scrambling combination lock 10 that may be constructed from the following components. A frame 14 is provided. The frame 14 supports at least two tumbler rings 18 and an activating slide 22. The tumbler rings 18 are marked with characters 26 used for a combination 30 for the lock 10. The lock 10 is openable only when the tumbler rings 18 are located in an open position 34 related to the combination 30. The activating slide 22 moves a locking bar 38 between a locked position 42 and an unlocked position 46. An urging member 100 extends downwardly from one side of the locking bar 38. A scrambling mechanism 50 is provided. The scrambling mechanism 50 is attached to the activating slide 22 and rotates the tumbler rings 18 from the open position 34 to another position 54 upon movement of the activating slide 22 to move the locking bar 38 from the unlocked position 46 to the locked position 42.

(2) In a variant of the invention, as illustrated in FIG. 1, the self-scrambling combination lock 10 includes a frame 14. The frame 14 has a top surface 58, first 62 and second 66 sides and a bottom surface 70 spaced from the top surface 58. At least two tumbler rings 18 are provided. The tumbler rings 18 are marked with characters 26 used for a combination 30 for the lock 10. An activating slide 22 is provided. The slide 22 moves a locking bar 38 between a locked position 42 and an unlocked position 46. The top surface 58 has openings 74, 78 for the tumbler rings 18 and the activating slide 22. As illustrated in FIGS. 2-4, the frame 14 supports an axle 82. The axle 82 has a series of longitudinal ridges 90 located on its exterior circumference 94 and supports the at least two tumbler rings 18. The longitudinal ridges 90 extend along a length of the axle 82 and are interrupted by unridged 98 portions, the unridged portions 98 permitting rotation of the tumbler rings 18. The tumbler rings 18 have mating grooves 102 located on interior circumferences 110 of the rings 18. The axle 82 has an axle end member 99 attached to its end. The tumbler rings 18 have mating grooves 102 located on interior circumferences 110 of the rings 18.

As illustrated in FIGS. 5 and 6, the mating grooves 102 permit the axle 82 to slide laterally through the tumbler rings 18 when the tumbler rings 18 are aligned according to the lock's combination 30. When the tumbler rings 18 are aligned according to the lock's combination 30, free lateral movement of the axle 82 is possible. The activating slide 22 moves the locking bar 38 from the locked position 42 to the unlocked position 46, and forces the urging member 100 against the axle end member 99, moving the axle 82 laterally. Each of the tumbler rings 18 has a barrel section 114. The barrel section 114 extends laterally on at least one side of the tumbler ring 18. The barrel section 114 is of a smaller diameter than the tumbler ring 18 and has a notch 118 located on its outer surface 122 parallel to a longitudinal axis 126 of the axle 82. At least one scrambling bar 130 is provided. The scrambling bar 130 has a first end 134 and a second end 138, is attached at the first end 134 to the locking bar 38 and has a notch-engaging feature 142 located at the second end 138. The scrambling bar 130 is urged toward the barrel section 114 by a first elastic element 146. The notch-engaging feature 142 fits into the notch 118 when the tumbler ring 18 is positioned according to the lock's combination 30 and the activating slide 22 moves the locking bar 38 from the locked position 42 to the unlocked position 46. The scrambling bar 130 turns the barrel section 114 when the activating slide 22 moves the locking bar 38 from the unlocked position 46 to the locked position 42. The barrel section 114 turns the tumbler ring 18 to a position 54 other than that of the lock's combination 30 upon locking of the lock 10.

Figure 1:
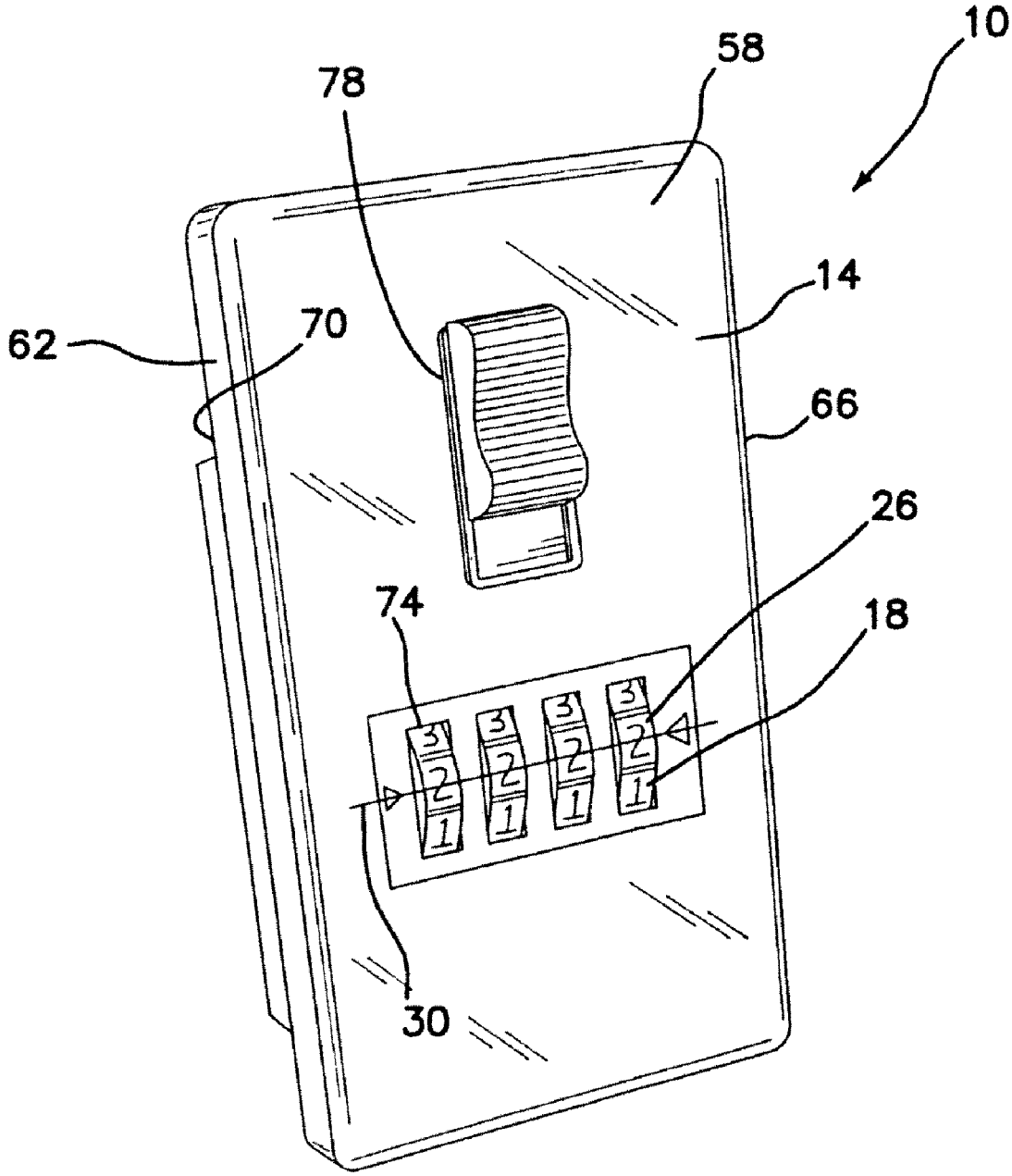
FIG. 1 is a perspective view of a first embodiment of the invention illustrating tumbler wheels and activating slide.
Figure 2:
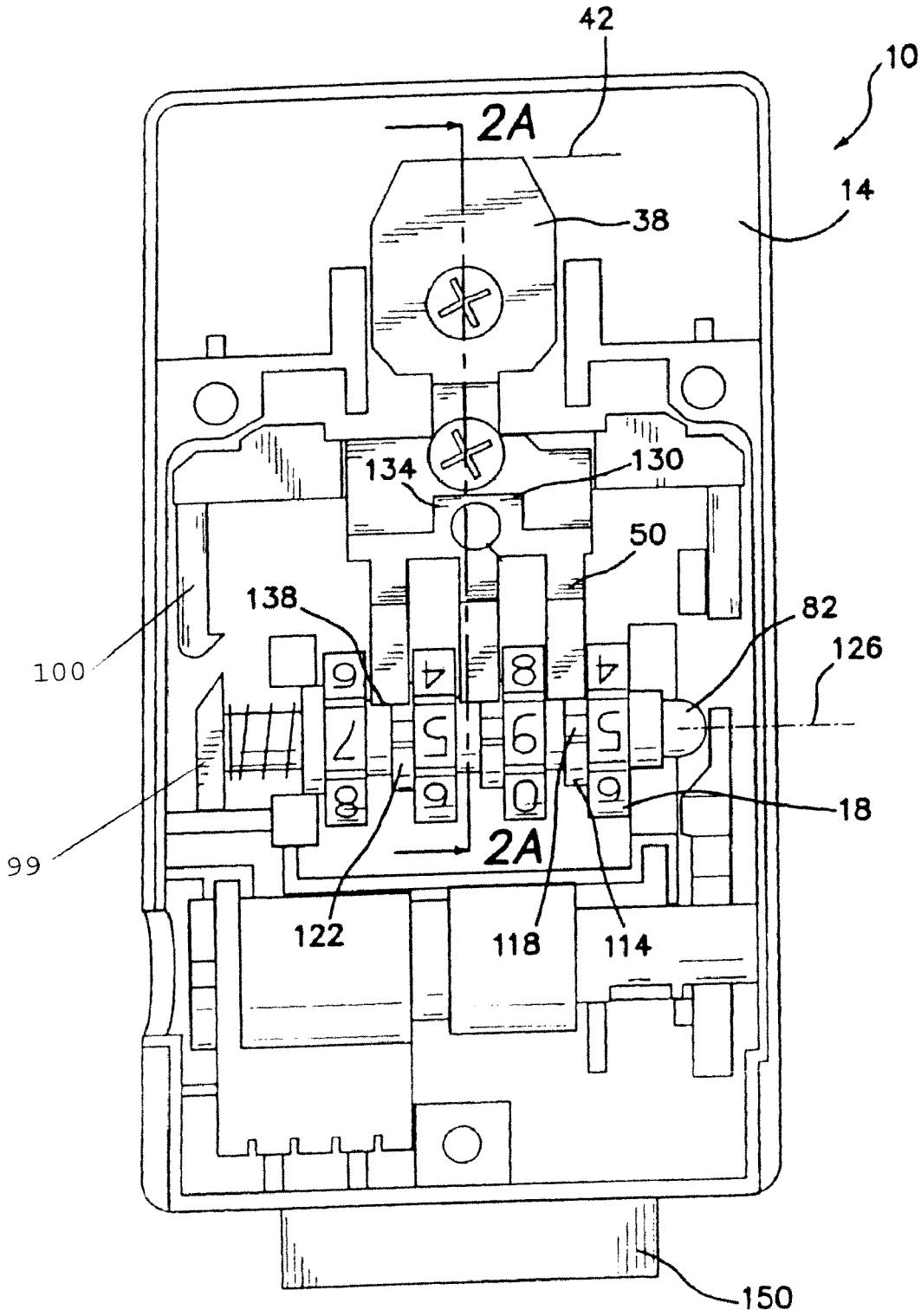
FIG. 2 is a rear plan view of the FIG. 1 embodiment illustrating the lock in a locked position with tumbler rings in a random position.
Figure 2A:
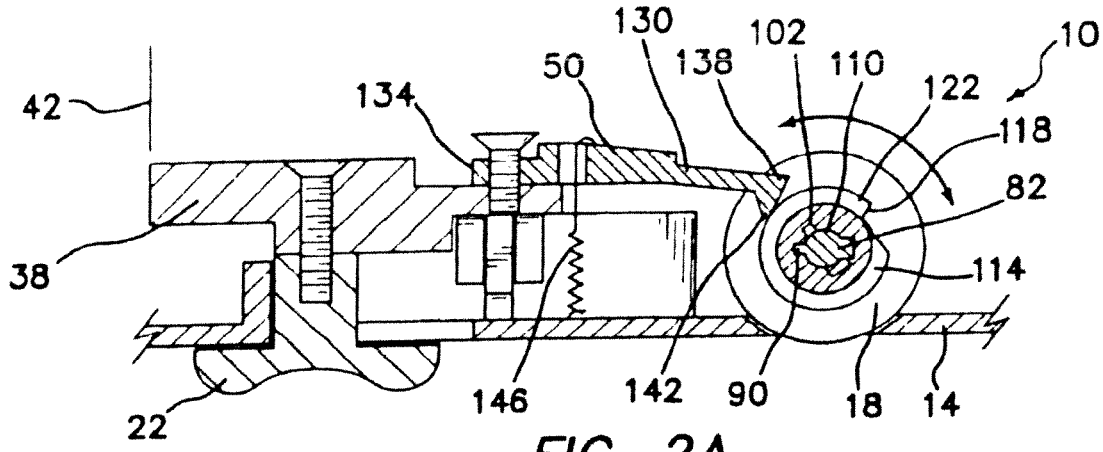
FIG. 2A is a cross-sectional view of the FIG. 1 embodiment taken along the line 2A-2A from FIG. 2, illustrating the scrambling bar in retracted position on top of outer circumference of the barrel section.
Figure 3A:
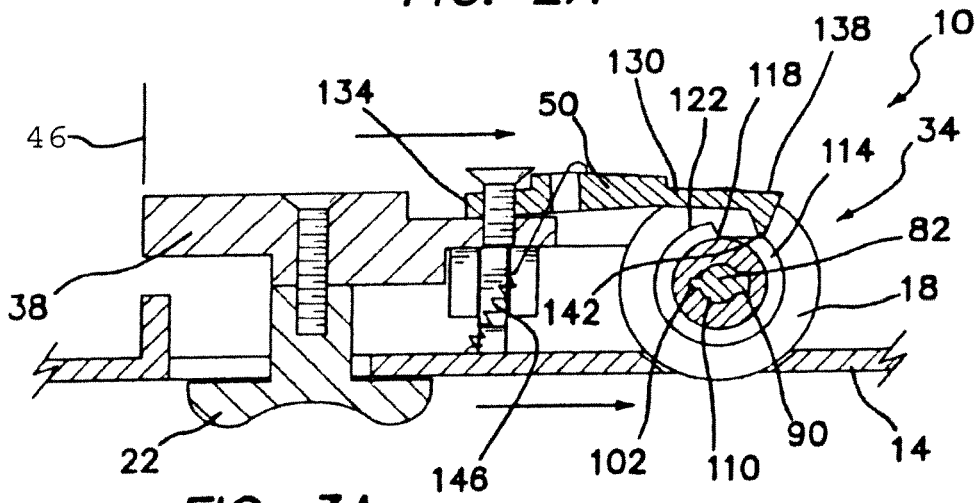
FIG. 3A is a cross-sectional view of the FIG. 1 embodiment taken along the line 3A-3A from FIG. 3, illustrating the scrambling bar in an extended position engaging the notch on the outer circumference of barrel section.
Figure 4A:
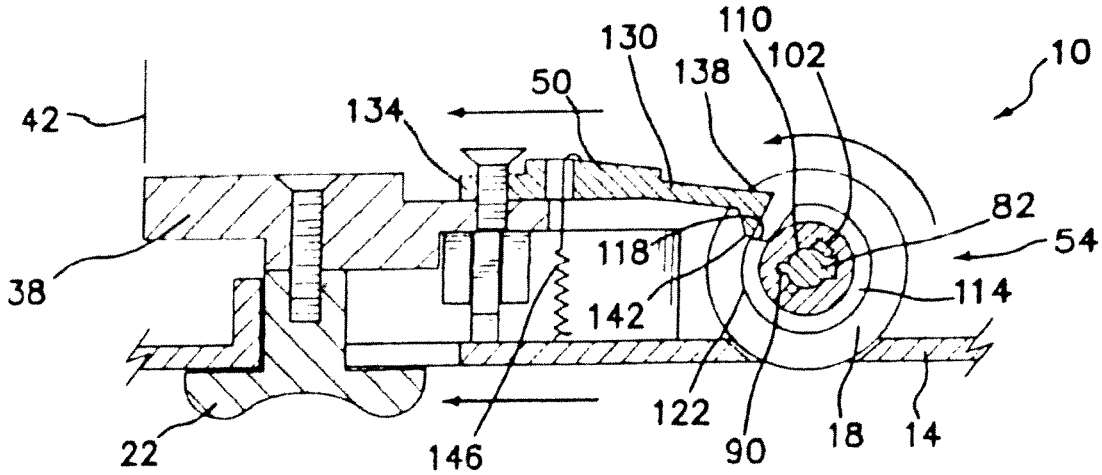
FIG. 4A is a cross-sectional view of the FIG. 1 embodiment taken along the line 4A-4A from FIG. 4, illustrating the scrambling bar in a retracted position engaging the notch on the outer circumference of barrel section.
Figure 3:
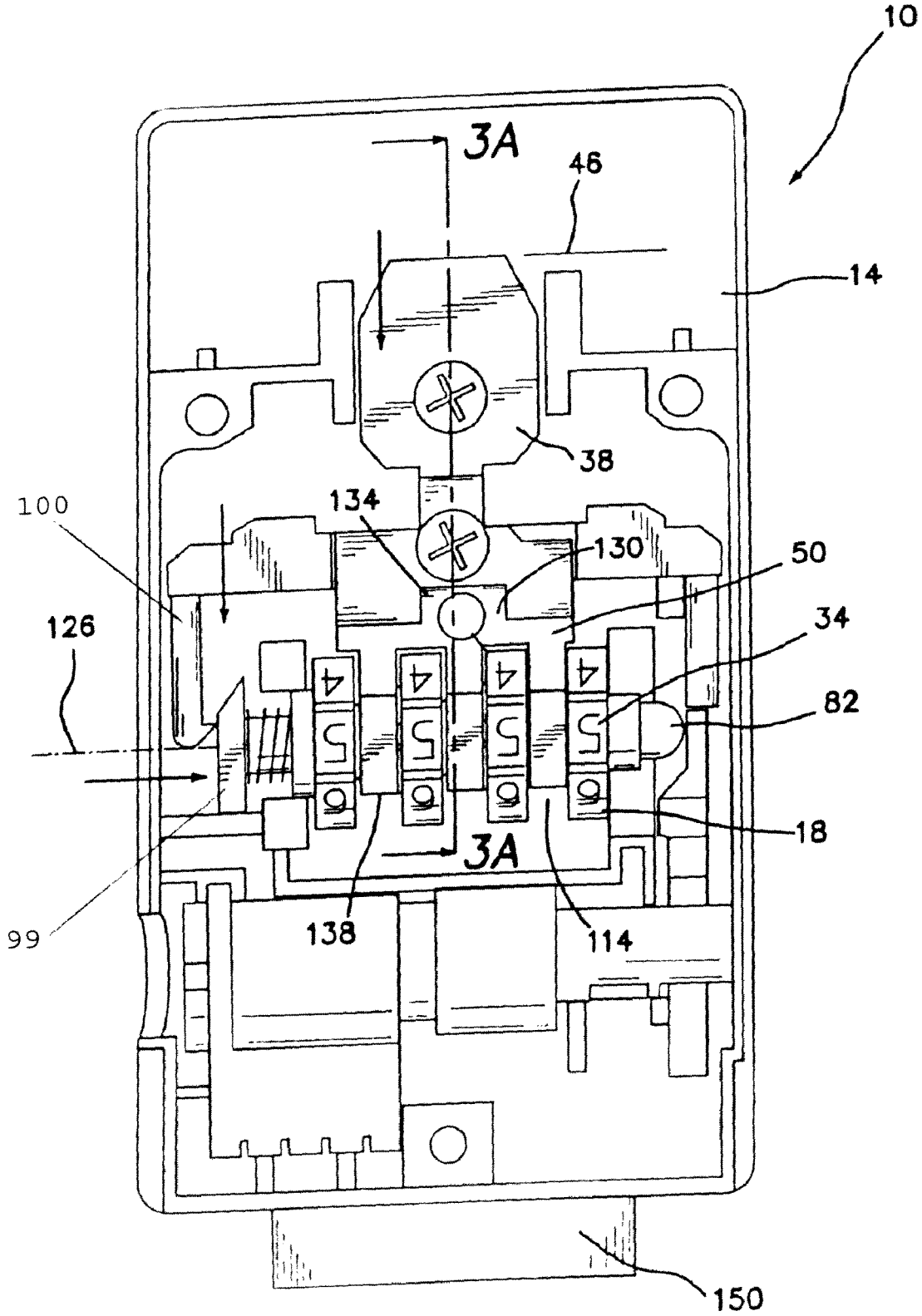
FIG. 3 is a rear plan view of the FIG. 1 embodiment illustrating the lock in an unlocked position with tumbler rings aligned to reflect the combination of the lock.
Figure 4:
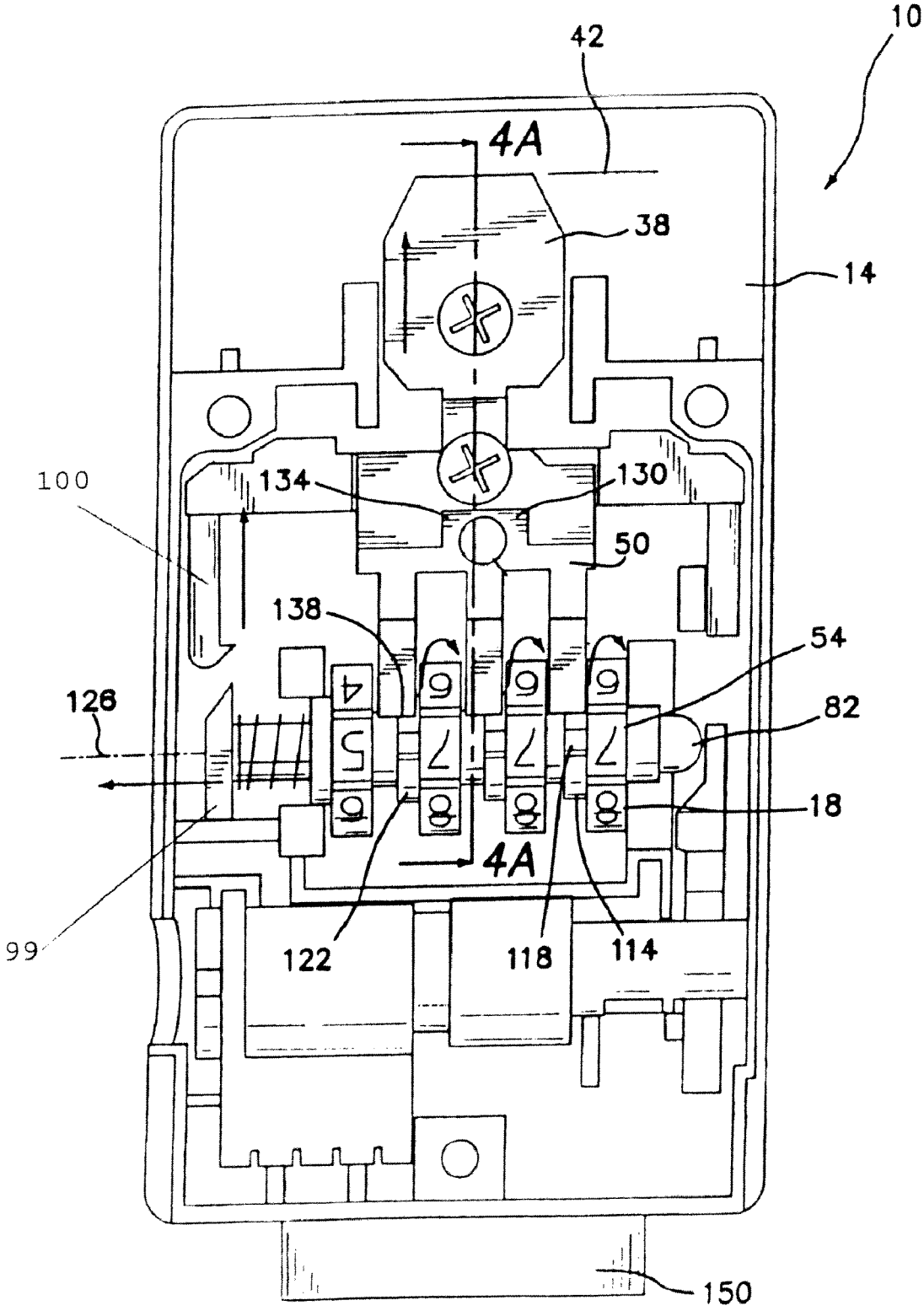
FIG. 4 is a rear plan view of the FIG. 1 embodiment illustrating the lock in the locked position with tumbler rings moved to a new position different from the combination of the lock.
Figure 5:
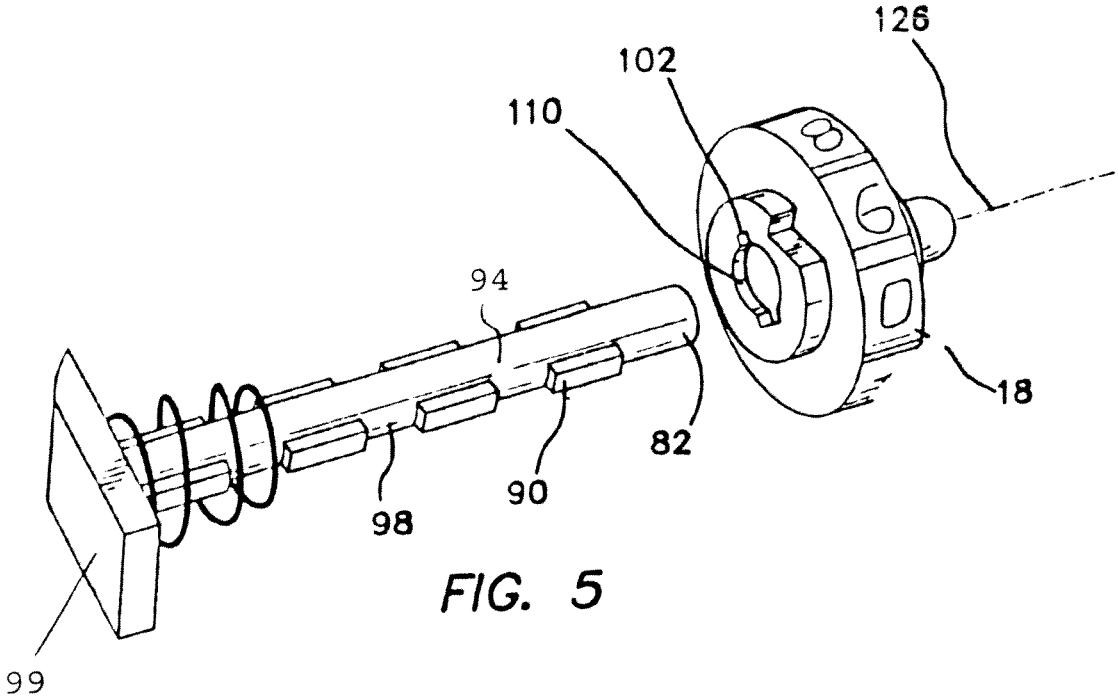
FIG. 5 is a perspective exploded view of the axle, tumbler ring and barrel section.
Figure 6:
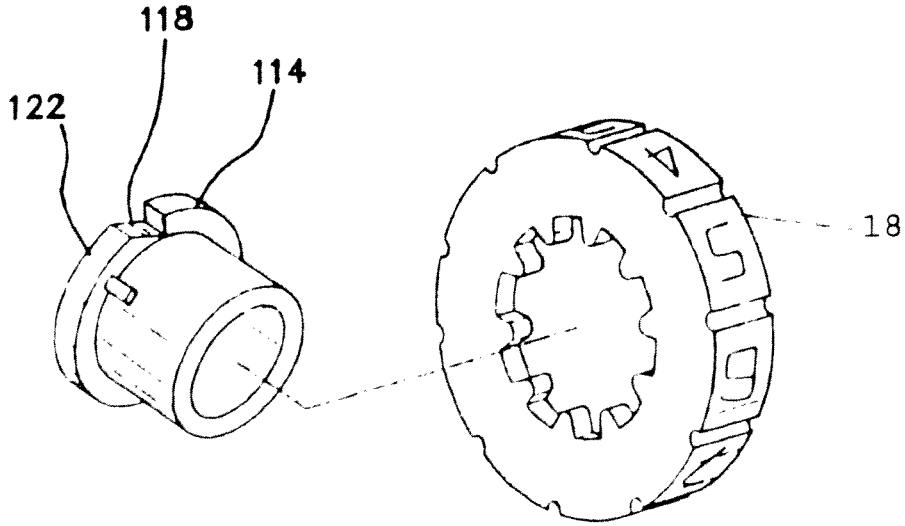
FIG. 6 is a perspective exploded view of the of the tumbler ring and barrel section.

(3) In another variant, as illustrated in FIG. 6, the tumbler rings 18 are removably attached to the barrel sections 114 to permit changing of the lock's combination 30.

(4) In still another variant, as illustrated in FIGS. 2-4 and 8, the frame 14 includes a retaining ledge 150, the retaining ledge 150 securing a lower end of the frame 14 to the body 154 by latching behind a lip 176 in the opening 174 of the body 154.

Figure 7:
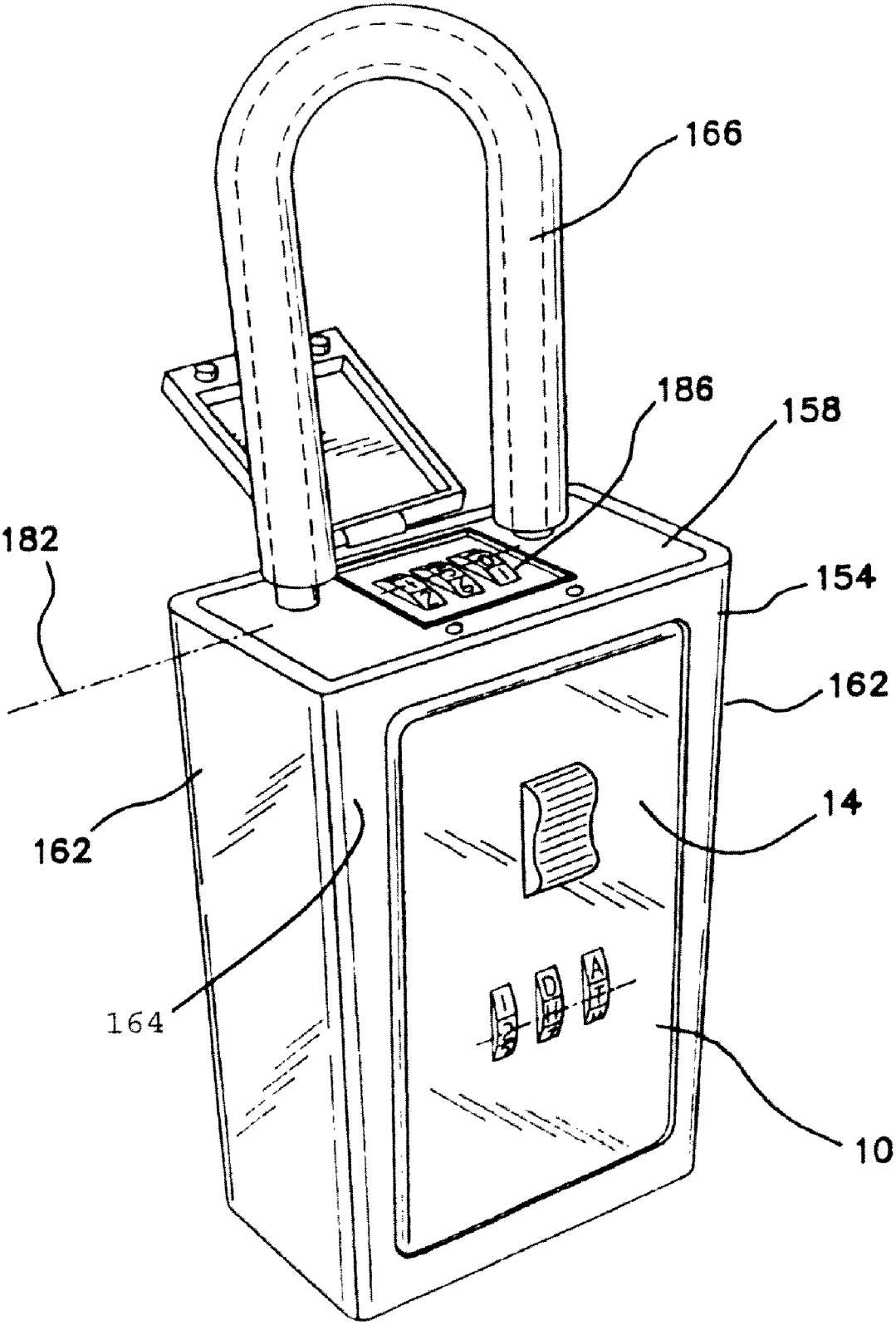
FIG. 7 is a perspective view of a lockbox employing the FIG. 1 embodiment lock in its door.
Figure 8:
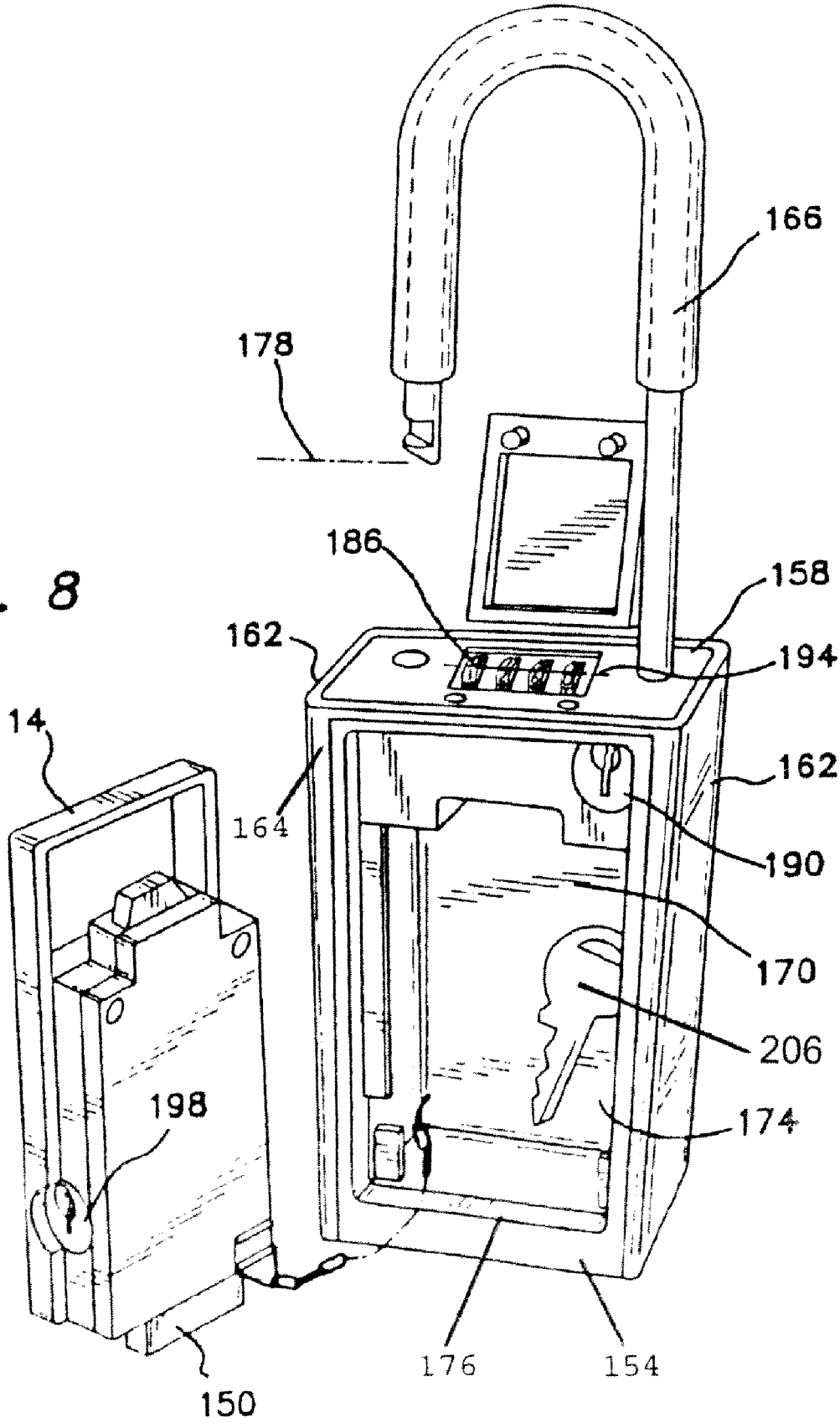
FIG. 8 is a perspective view of the FIG. 7 lockbox in an open position illustrating the retaining ledge.

(5) In yet another variant, as illustrated in FIGS. 7 and 8, a body 154 is provided. The body 154 has a top surface 158, a bottom surface (not shown), side surfaces 162, a front surface 164, a rear surface (not shown), an attachment bail 166 and an interior cavity 170, the interior cavity 170 extends inwardly from an opening 174 in the front surface 164. The attachment bail 166 extends upwardly from the top surface 158 of the body 154 and is slidable from a first, open position 178 to a second, closed position 182. A second combination lock 186 is provided. The second combination lock 186 is located upon the top surface 158 and secures the bail 166 in the second, closed position 182. A first key lock 190 is provided. The first key lock 190 is located within the interior cavity 170 and controls selection of a combination 194 for the second combination lock 186. The frame 14 is sized and shaped to be removably secured to the opening 174. The frame 14 controls access to the interior cavity 170 through the opening 174. A second key lock 198 is provided. The second key lock 198 is located in the frame 14 within the interior cavity 170 and controls selection of a combination 30 for the self-scrambling combination lock 10. When the attachment bail 166 is locked through a building fixture (not shown) with the second combination lock 186, the combination 30 of the self-scrambling combination lock 10 is set and secured with the second key lock 198, a building key 206 can be inserted in the interior cavity 170 and the frame 14 secured to the opening 174 with the self-scrambling combination lock 10, access to a building is permitted to only those who have been given the combination 30 and changes to the combination 30 and removal of the body 154 are prevented.

Figure 9A:
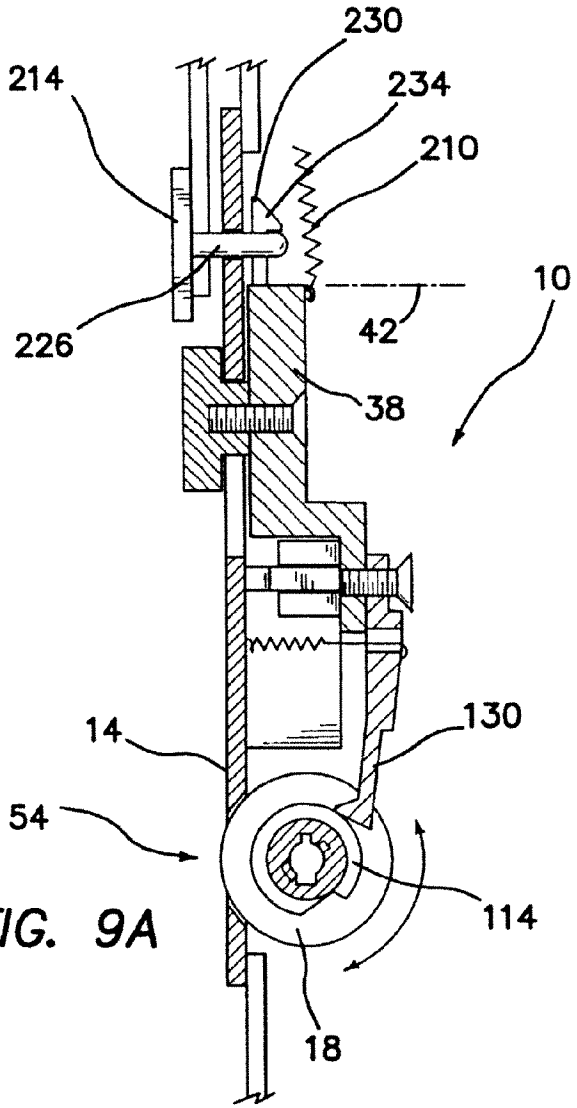
FIG. 9A is a cross-sectional view of the FIG. 9 embodiment taken along the line 9A-9A from FIG. 9, illustrating a second elastic means for closing the lock.
Figure 9:
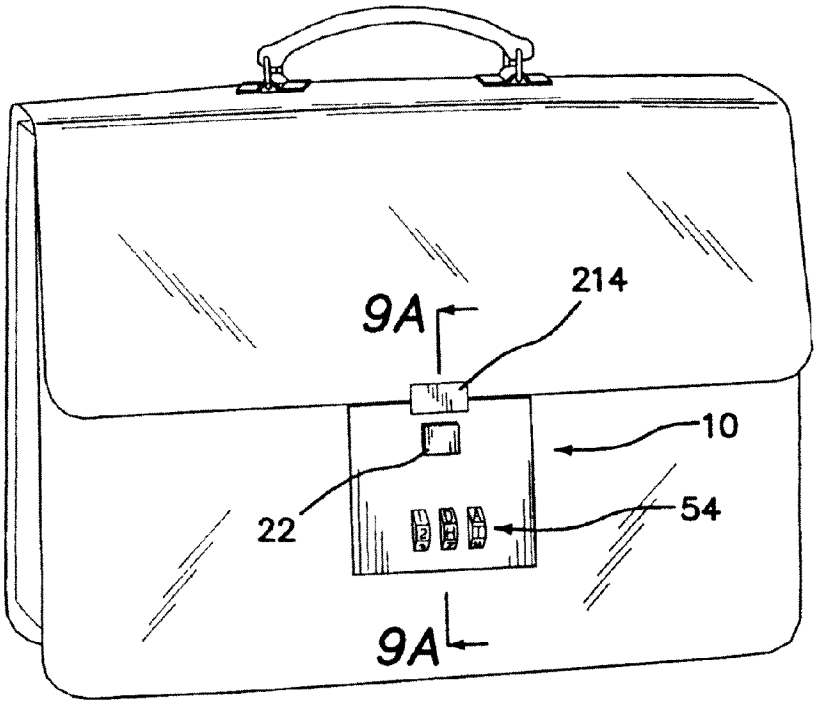
FIG. 9 is a perspective view of a briefcase employing the self-scrambling combination lock.

(6) In a final variant of the invention, as illustrated in FIGS. 9 and 9A, the frame 14 includes a second elastic element 210. The second elastic element 210 urges the locking bar 38 toward the locked position 42. A hasp 214 is provided. The hasp 214 is disposed adjacent the frame 14 and has an engaging loop 226 sized and shaped to fit slidably over an end 230 of the locking bar 38. The locking bar 38 has a beveled surface 234 at the end 230 so as to slide over the engaging loop 226. The scrambling bar 130 turns the barrel section 114 when the locking bar 38 is urged by the second elastic element 210 from the unlocked position 46 to the locked position 42. The barrel section 114 turns the tumbler ring 18 to a position 54 other than that of the lock's combination 30 upon locking of the lock 10.

The self-scrambling combination lock 10 has been described with reference to particular embodiments. Other modifications and enhancements can be made without departing from the spirit and scope of the claims that follow.

The invention claimed is:

1. A self-scrambling combination lock, comprising:

a frame, said frame having a top surface, first and second sides and a bottom surface spaced from said top surface;

at least two tumbler rings, said tumbler rings being marked with characters used for a combination for said self-scrambling combination lock;

an activating slide, said slide moving a locking bar between a locked position and an unlocked position;

said top surface having openings for said at least two tumbler rings and said activating slide;

said frame supporting an axle, said axle having an axle end member disposed at a first end and a series of longitudinal ridges disposed on its exterior circumference and supporting said at least two tumbler rings;

an urging member, said urging member being attached to said locking bar and disposed to contact said axle end member as said locking bar is moved from said locked position to said unlocked position;

said longitudinal ridges extending along a length of said axle and being interrupted by unridged portions, said portions permitting rotation of said tumbler rings;

said tumbler rings having mating grooves disposed on interior circumferences of said tumbler rings, said mating grooves permitting said axle to slide laterally through said tumbler rings when said rings are aligned according to said self-scrambling combination lock's combination and force input from said activating slide is applied to said axle end member by said urging member, lateral movement of said axle permitting said locking bar to move between said locked position and said unlocked position;

each of said tumbler rings having a barrel section, each of said barrel sections extending laterally on at least one side of each of said tumbler rings;

each of said barrel sections being of a smaller diameter than each of said tumbler rings and having a notch disposed on its outer surface, parallel to a longitudinal axis of said axle;

at least one scrambling bar, said scrambling bar having a first end and a second end, being attached at said first end to said locking bar and having a notch-engaging feature disposed at said second end;

each of said scrambling bars being urged towards one of said barrel sections by a first elastic element;

said notch-engaging feature fitting into said notch when said tumbler ring is positioned according to said self-scrambling combination lock's combination and said activating slide moves said locking bar from said locked position to said unlocked position;

each of said scrambling bars turning one of said barrel sections when said activating slide moves said locking bar from said unlocked position to said locked position;

each of said barrel sections turns one tumbler ring to a position other than that of said self-scrambling combination lock's combination upon locking of said self-scrambling combination lock.

2. The self-scrambling combination lock, as described in claim 1, wherein said tumbler rings are removably attached to said barrel sections to permit changing of said self-scrambling combination lock's combination.

3. The self-scrambling combination lock, as described in claim 1, wherein said frame further comprises a retaining ledge, said retaining ledge securing a lower end of said frame to a body by latching behind a lip in an opening of said body.

4. The self-scrambling combination lock, as described in claim 1, further comprising:

a body, said body having a top surface, a bottom surface, side surfaces, a front surface, a rear surface, an attachment bail and an interior cavity, said interior cavity extending inwardly from an opening in said front surface;

said attachment bail extending upwardly from said top surface of said body and being slidable from a first, open position to a second, closed position;

a second combination lock, said second combination lock being disposed upon said top surface and securing said bail in said second, closed position;

a first key lock, said first key lock being disposed within said interior cavity and controlling selection of a combination for said second combination lock;

said frame being sized and shaped to be removably secured to said opening, controlling access to said interior cavity through said opening;

a second key lock, said second key lock being disposed in said frame within said interior cavity and controlling selection of a combination for said self-scrambling combination lock; and whereby, when said attachment bail is locked through a building fixture with said second combination lock, said combination of said self-scrambling combination lock is set and secured with said second key lock, said frame is secured to said opening with said self-scrambling combination lock.

5. The self-scrambling combination lock, as described in claim 1, wherein said frame further comprises:

a second elastic element, said second elastic element urging said locking bar toward said locked position;

a hasp, said hasp being disposed adjacent said frame and having an engaging loop sized and shaped to fit slidably over an end of said locking bar;

said locking bar having a beveled surface at said end so as to slide over said engaging loop;

each of said scrambling bars turning one of said barrel sections when said locking bar is urged by said second elastic element from said unlocked position to said locked position; and each of said barrel sections turns one tumbler ring to a position other than that of said self-scrambling combination lock's combination upon locking of said self-scrambling combination lock.

6. A self-scrambling combination lock, comprising:

a frame, said frame supporting at least two tumbler rings and an activating slide;

said tumbler rings being marked with characters used for a combination for said self-scrambling combination lock, said self-scrambling combination lock being openable only when said tumbler rings are disposed in an open position related to said combination;

said activating slide moving a locking bar between a locked position and an unlocked position;

a scrambling mechanism, said scrambling mechanism being attached to said activating slide and rotating said at least two tumbler rings from said open position to another position upon movement of said activating slide to move the locking bar from said unlocked position to said locked position;

a body, said body having a top surface, a bottom surface, side surfaces, a front surface, a rear surface, an attachment bail and an interior cavity, said interior cavity extending inwardly from an opening in said front surface;

a retaining ledge, said retaining ledge securing a lower end of said frame to said body by latching behind a lip in said opening of said body;

said attachment bail extending upwardly from said top surface of said body and being slidable from a first, open position to a second, closed position;

a second combination lock, said second combination lock being disposed upon said top surface and securing said bail in said second, closed position;

a first key lock, said first key lock being disposed within said interior cavity and controlling selection of a combination for said second combination lock;

said frame being sized and shaped to be removably secured to said opening, controlling access to said interior cavity through said opening; and a second key lock, said second key lock being disposed in said frame within said interior cavity and controlling selection of a combination for said self-scrambling combination lock;

whereby, when said attachment bail is locked through a building fixture with said second combination lock, said combination of said self-scrambling combination lock is set and secured with said second key lock, said frame secured to said opening with said self-scrambling combination lock.

7. A self-scrambling combination lock, comprising:

a frame, said frame having a top surface, first and second sides and a bottom surface spaced from said top surface;

at least two tumbler rings, said tumbler rings being marked with characters used for a combination for said self-scrambling combination lock;

an activating slide, said slide moving a locking bar between a locked position and an unlocked position;

said top surface having openings for said at least two tumbler rings and said activating slide;

said frame supporting an axle, said axle having an axle end member disposed at an exposed end, a series of longitudinal ridges disposed on its exterior circumference and supporting said at least two tumbler rings;

an urging member, said urging member being attached to said locking bar and disposed to contact said axle end member as said locking bar is moved from said locked position to said unlocked position;

said longitudinal ridges extending along a length of said axle and being interrupted by unridged portions, said portions permitting rotation of said tumbler rings;

said tumbler rings having mating grooves disposed on interior circumferences of said rings, said mating grooves permitting said axle to slide laterally through said tumbler rings when said rings are aligned according to said self-scrambling combination lock's combination and force input from said activating slide is applied to said axle end member by said urging member, lateral movement of said axle permitting said locking bar to move between said locked position and said unlocked position;

each of said tumbler rings having a barrel section, each of said barrel sections extending laterally on at least one side of each of said tumbler rings;

each of said barrel sections being of a smaller diameter than each of said tumbler rings and having a notch disposed on its outer surface, parallel to a longitudinal axis of said axle;

at least one scrambling bar, said scrambling bar having a first end and a second end, being attached at said first end to said locking bar and having a notch-engaging feature disposed at said second end;

each of said scrambling bars being urged toward one of said barrel sections by a first elastic element;

said notch-engaging feature fitting into said notch when said tumbler ring is positioned according to said self-scrambling combination lock's combination and said activating slide moves said locking bar from said locked position to said unlocked position;

each of said scrambling bars turning said one of said barrel sections when said activating slide moves said locking bar from said unlocked position to said locked position;

each of said barrel sections turning one of said tumbler rings to a position other than that of said self-scrambling combination lock's combination upon locking of said self-scrambling combination lock;

a body, said body having a top surface, a bottom surface, side surfaces, a front surface, a rear surface, an attachment bail and an interior cavity, said interior cavity extending inwardly from an opening in said front surface;

a retaining ledge, said retaining ledge securing a lower end of said frame to said body by being disposed over a lip in said opening in said body;

said attachment bail extending upwardly from said top surface of said body and being slidable from a first, open position to a second, closed position;

a second combination lock, said second combination lock being disposed upon said top surface and securing said bail in said second, closed position;

a first key lock, said first key lock being disposed within said interior cavity and controlling selection of a combination for said second combination lock; and said frame being sized and shaped to be removably secured to said opening, controlling access to said interior cavity through said opening; and a second key lock, said second key lock being disposed in said frame within said interior cavity and controlling selection of a combination for said self-scrambling combination lock;

whereby, when said attachment bail is locked through a building fixture with said second combination lock, said combination of said self-scrambling combination lock is set and secured with said second key lock, said frame is secured to said opening with said self-scrambling combination lock.

8. A self-scrambling combination lock, comprising:

a frame;

at least two tumbler rings supported on said frame, said tumbler rings having indices used for a combination for said self-scrambling combination lock, said self-scrambling combination lock being openable only when said tumbler rings are disposed in an open position related to said combination;

an activating slide supported on said frame, said activating slide moving a locking bar between a locked position and an unlocked position; and a scrambling mechanism, comprising:

at least one barrel section, each attached to one of said tumbler rings and extending laterally on at least one side of said tumbler ring, and having a notch disposed on an outer face thereof; and at least one scrambling bar with a first end attached to said locking bar and a second end having a notch-engaging feature disposed thereon for fitting into the notch;

whereby, said scrambling bar rotates said barrel section by engaging the notch, causing said tumbler ring to rotate therewith while said activating slide moves said locking bar from said unlocked position to said locked position.

9. The self-scrambling combination lock of claim 8, further comprising:

an axle supported on said frame, said axle having an axle end member disposed at a first end thereof and a series of longitudinal ridges disposed on its exterior circumference and supporting said tumbler rings;

said longitudinal ridges extending along a length of said axle and being interrupted by unridged portions, said portions permitting rotation of said tumbler rings; and an urging member, said urging member being attached to said locking bar and disposed to contact said axle end member as said locking bar is moved from said locked position to said unlocked position;

said tumbler rings having mating grooves disposed on interior circumferences of said rings, said mating groves permitting said axle to slide laterally through said tumbler rings when said rings are aligned according to said self-scrambling combination lock's combination and force input from said activating slide is applied to said axle end member by said urging member, lateral movement of said axle permitting said locking bar to move between said locked position and said unlocked position.

10. The self-scrambling combination lock of claim 8, wherein said barrel section is of a smaller diameter than at least one of said tumbler rings.

11. The self-scrambling combination lock of claim 8, wherein the indices include one or a combination of the following:

alpha characters; and numeric characters.

12. The self-scrambling combination lock of claim 8, wherein:

said frame has a top surface, first and second sides and a bottom surface spaced from said top surface, said top surface having openings for said at least two tumbler rings and said activating slide.

13. The self-scrambling combination lock of claim 8, further comprising:

an elastic element attached to said scrambling bar for urging said scrambling bar toward said barrel section.

14. The self-scrambling combination lock of claim 8, further comprising:

an elastic element attached to said locking bar for urging said locking bar toward said locked position; and a hasp disposed adjacent said frame and having an engaging loop sized and shaped to fit slidably over an end of said locking bar;

said locking bar having a beveled surface at said end thereof so as to slide over said engaging loop.

15. The self-scrambling combination lock of claim 8, wherein said tumbler rings are removably attached to said barrel sections to permit changing of said self-scrambling combination lock's combination.

16. The self-scrambling combination lock of claim 8, further comprising:

a body, said body having a top surface, a bottom surface, side surfaces, a front surface, a rear surface, an attachment bail and an interior cavity, said interior cavity extending inwardly from an opening in said front surface;

said attachment bail disposed on said top surface of said body and extending upwardly therefrom, said attachment bail being slidable from a first, open position to a second, closed position; and a second combination lock being disposed on said body for securing said bail in said second, closed position;

said frame being sized and shaped to be removably secured to said opening, controlling access to said interior cavity through said opening.

17. The self-scrambling combination lock of claim 16, further comprising:

a key lock, said key lock being disposed within said interior cavity and controlling selection of a combination for said second combination lock.

18. The self-scrambling combination lock of claim 16, further comprising:

a key lock, said key lock being disposed within said interior cavity and controlling selection of a combination for said self-scrambling combination lock.

19. The self-scrambling combination lock of claim 16, wherein said frame further comprises a retaining ledge for securing a lower end of said frame to said body by being disposed over a lip in said opening in said body.

* * * * *